US007878523B1

(12) United States Patent
Ferch

(10) Patent No.: US 7,878,523 B1
(45) Date of Patent: Feb. 1, 2011

(54) WHEELCHAIR POSITION CONTROL

(76) Inventor: Herman D. Ferch, P.O. Box 299, La Puente, CA (US) 91747

( * ) Notice: Subject to any disclaimer, the term of this patent is extended or adjusted under 35 U.S.C. 154(b) by 268 days.

(21) Appl. No.: 12/152,006

(22) Filed: May 13, 2008

(51) Int. Cl.
*A61G 5/10* (2006.01)

(52) U.S. Cl. ..... 280/304.1; 280/304.5

(58) Field of Classification Search ..... 280/304.1, 280/250.1, 288.4, 304.5, 650, 657
See application file for complete search history.

(56) References Cited

U.S. PATENT DOCUMENTS

| | | | | |
|---|---|---|---|---|
| 2,818,910 | A * | 1/1958 | Hawkins | 297/45 |
| 3,338,409 | A | 8/1967 | Koellisch | |
| 3,985,275 | A | 10/1976 | Allen | |
| 4,043,493 | A | 8/1977 | Camello | |
| 4,221,313 | A | 9/1980 | Stowe | |
| 4,325,576 | A * | 4/1982 | Guthrie | 296/65.04 |
| 4,690,364 | A * | 9/1987 | Constantin | 248/503.1 |
| 4,708,357 | A | 11/1987 | Soderbaum | |
| 4,877,260 | A * | 10/1989 | Howland | 280/304.1 |
| 4,964,648 | A | 10/1990 | Berkowitz | |
| 5,186,585 | A * | 2/1993 | Sousa et al. | 410/9 |
| 5,497,926 | A * | 3/1996 | Rittenhouse | 224/407 |
| 5,529,427 | A * | 6/1996 | Bost | 403/391 |
| 5,954,402 | A * | 9/1999 | McInturff | 297/440.22 |
| 6,961,978 | B2 | 11/2005 | Earley et al. | |

* cited by examiner

*Primary Examiner*—Anne Marie M. Boehler
(74) *Attorney, Agent, or Firm*—William W. Haefliger

(57) ABSTRACT

A positioner means co-operable with a collapsed wheelchair frame, including a front frame, and configured, for selectively retaining the wheelchair in collapsed position, in one position of said positioner means, and for allowing expansion of the wheelchair in another position of the positioner means relative to the frame, and for positioning said frame to space the wheelchair front wheels to allow free swiveling thereof, and comprising, in combination, a clamp attached to said frame at two spaced apart locations associated with the two front wheels, to lock the wheels at predetermined spacing, for swiveling, the clamp including brackets sized to releasably push-connect to the front frame at said two locations.

5 Claims, 6 Drawing Sheets

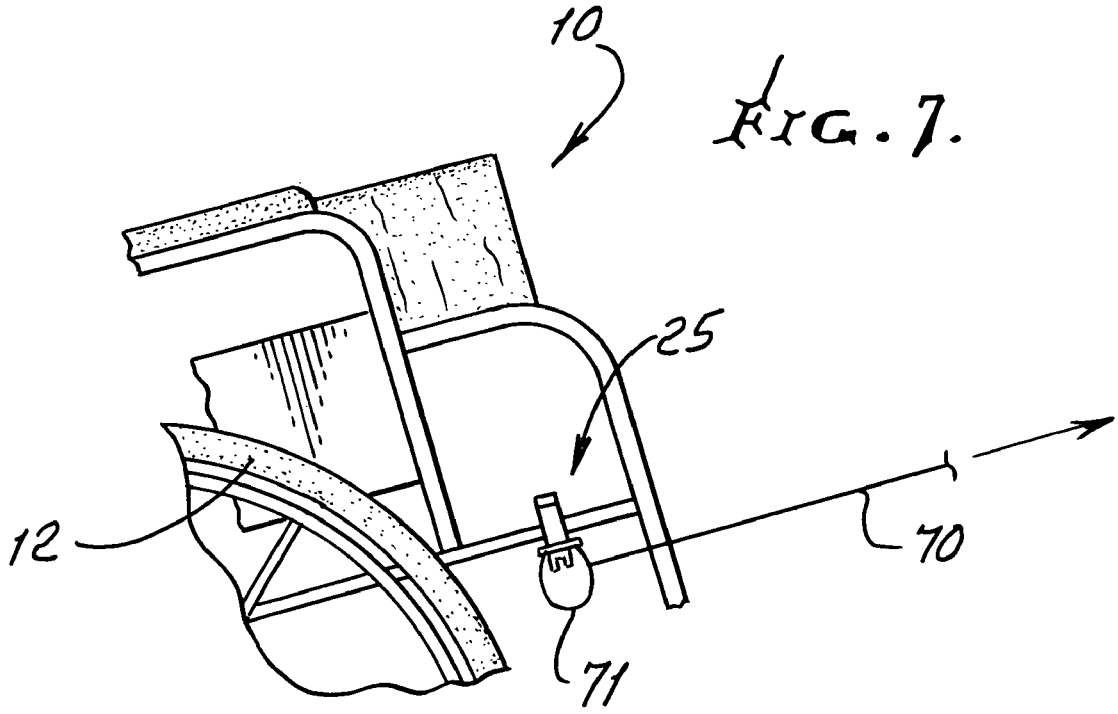
FIG. 7.
FIG. 8.
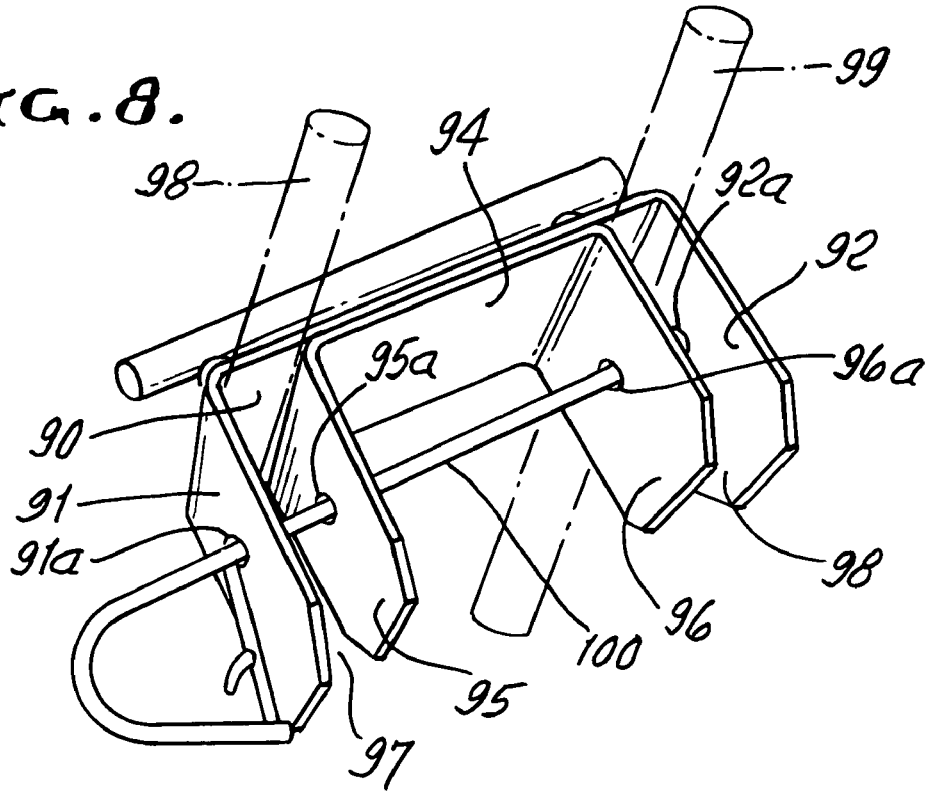

WHEELCHAIR POSITION CONTROL

BACKGROUND OF THE INVENTION

This invention relates generally to wheelchair stability, and more particularly to maintaining stability and maneuverability of collapsed wheelchairs.

Wheelchairs have collapsed positions, in which left and right side frame members are displaced toward one another. In that position, the chair is desirably maneuverable by pushing; however, the front wheels commonly swivel into mutually interfering positions, blocking maneuverability of the pushed chair. There is need for simple reliable means for optionally holding the chair in collapsed position of wheel non-interference, or, for quickly and easily allowing expansion of the chair for normal use. There is also need for improvements allowing wheelchair towing, and lifting, in easily enabled manner, as well as additional advantages as will be seen.

SUMMARY OF THE INVENTION

It is a major obtain of the invention to provide improvements meeting the above needs, in a simple reliable, and durable manner. Basically, the invention provides positioning means co-operable with a collapsed wheelchair frame, and configured for a) selectively retaining the wheelchair in collapsed position, in one position of the positioner means, and for allowing expansion of the wheelchair in another position of the positioner means, relative to the frame, b) and for positioning the frame to space the wheelchair front wheels to allow free swiveling thereof, comprising, in combination, c) a clamp attached to the frame at two spaced apart locations associated with positioning of the two front wheels, to lock the wheels at predetermined spacing, for swiveling, d) the clamp including brackets sized to releasably clamp to the front frame at said two locations.

Another object comprises provision of each of the brackets to include members at least one of which is spring urged toward the other member, the members having concave gripping surfaces facing toward one another to forcibly embrace a tubular frame member.

As will be seen, such members typically consist of one of the following:

i) metal ii) molded plastic material

Also the members typically have locally angled cam surfaces spaced apart to push against the tubular frame members and guide the concave gripping surfaces into clamping relation with opposite sides of the frame members.

A further object includes provision of the clamp means to include a strut to which the brackets are connected, and whereby wheelchair frame members are releasably embraced and positioned by the brackets.

Yet another object is provision of a clamp that has a position in which only one frame member is embraced by one bracket, the strut hanging in an alternate position in which the other bracket is spaced and disconnected from the other frame member.

An additional object is the provision of a strut that has one selected position located above the levels of the frame members, and an alternative selected position located below the levels of the frame members.

As will be seen, a tow line may be connected to the strut for towing the wheelchair, the line connectable to the strut in either up or down position of the connected strut.

An added object includes provision of a clamp with a laterally elongated strut, and fixed position bracket arms joined to the strut, with through openings in those arms, there being an elongated retainer member removably projecting through the openings to hold the brackets in frame member retained position.

These and other objects and advantages of the invention, as well as the details of illustrative embodiments, will be more fully understood from the following specification and drawings, in which:

DRAWING DESCRIPTION

Figure 2:
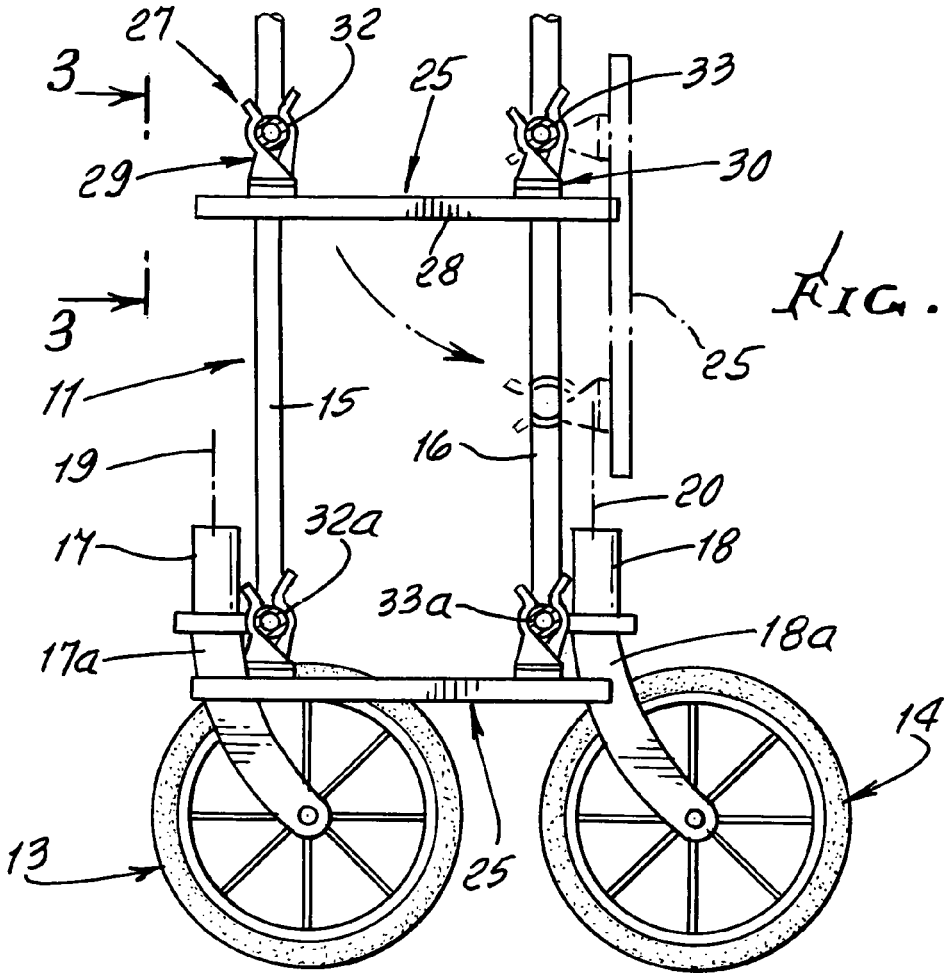
FIG. 2 is a frontal elevation, taken in section on lines 2-2 of FIG. 1.
Figure 3:
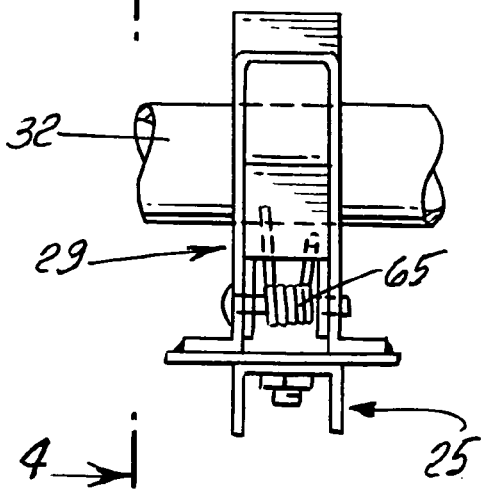
Figure 5:
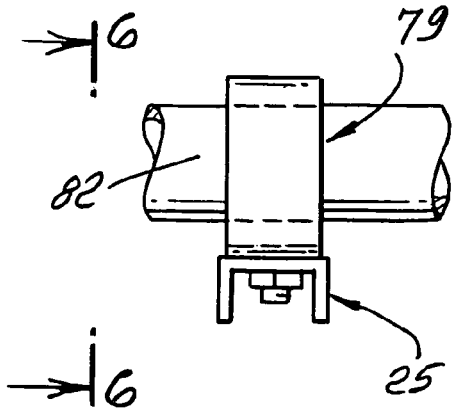
Figure 2A:
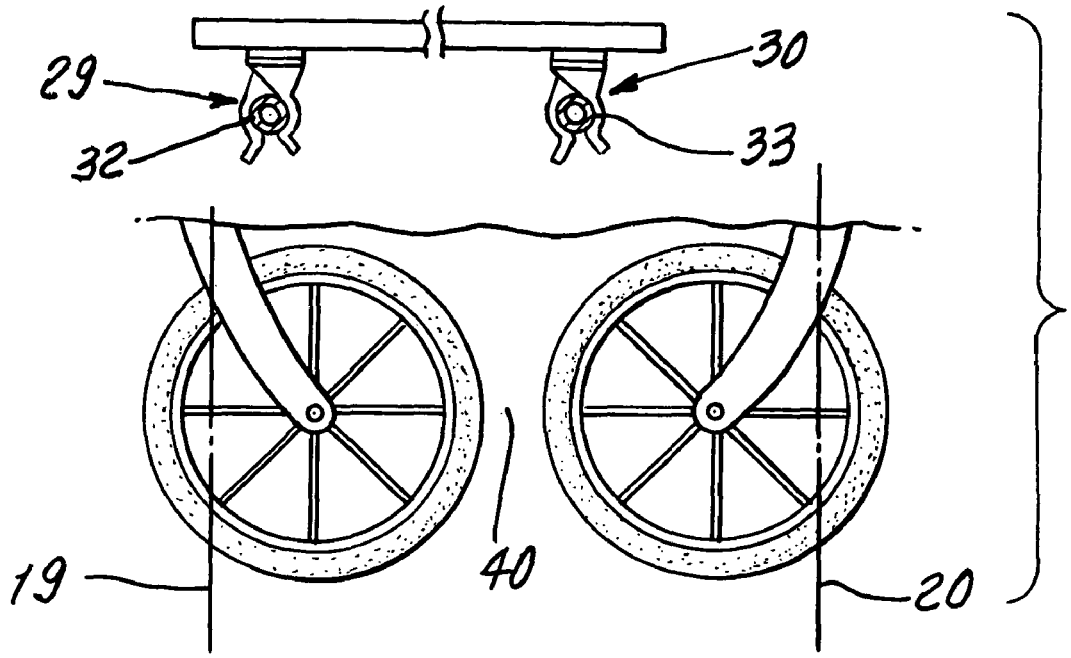
Figure 4:
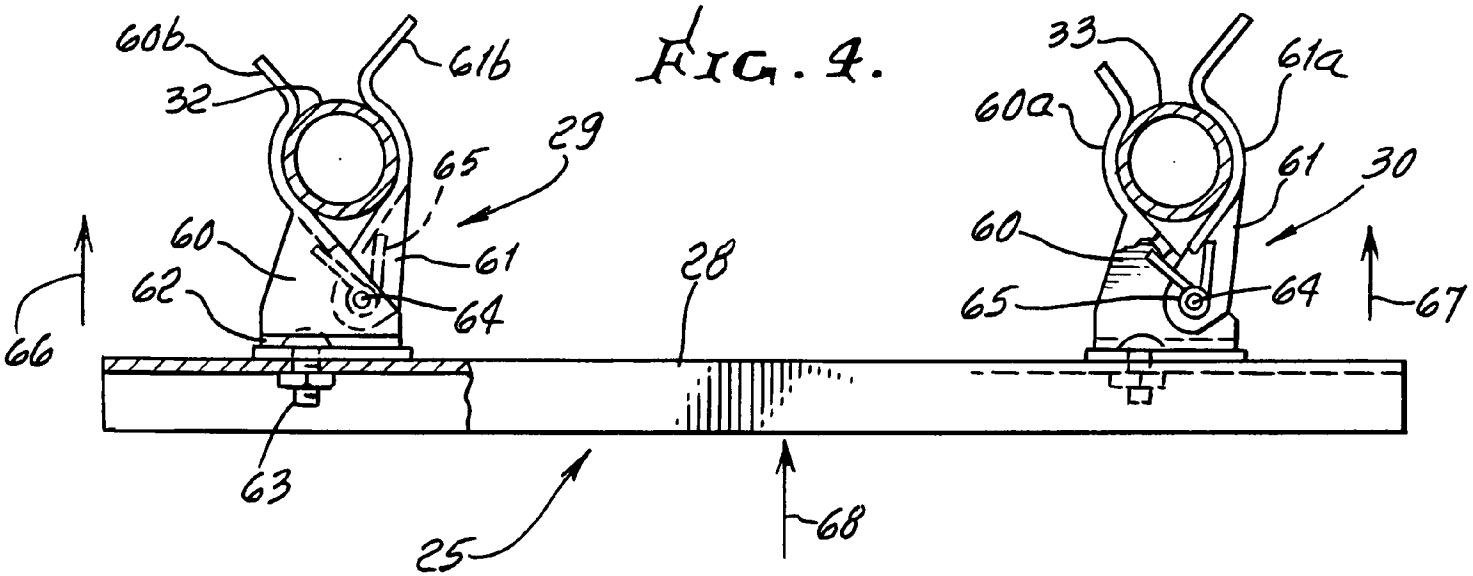
Figure 4A:
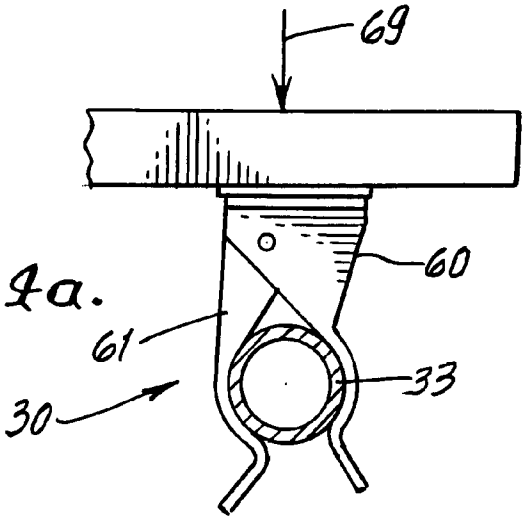
Figure 6:
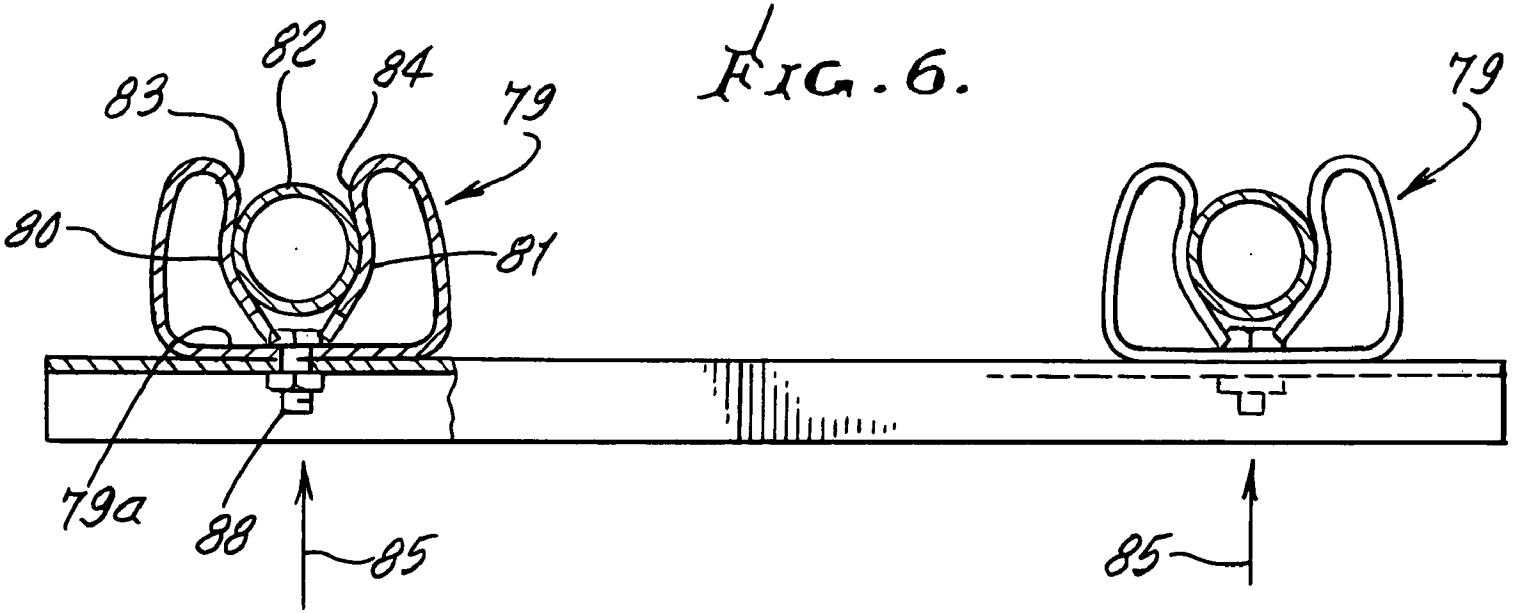
Figure 6A:
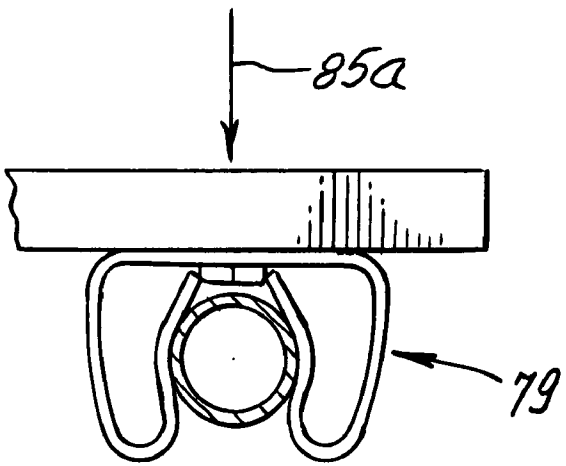

FIG. 2*a* is a view like FIG. 2 showing clamp installation to prevent wheel clashing;

FIG. 3 is an enlarged side elevation taken on lines 3-3 of FIG. 2 and showing clamp configuration;

FIG. 4 is an elevation taken on lines 4-4 of FIG. 3 and showing upward installation of the clamp;

FIG. 4*a* is a view showing downward installation of the FIG. 3 clamp;

FIG. 5 is a view like FIG. 3, showing a modified clamp configuration;

FIG. 6 is an elevation taken on lines 6-6 of FIG. 5, and showing upward installation of the modified clamp;

FIG. 6*a* is a view showing downward installation of FIG. 5 modified clamp;

FIG. 7 is a fragmentary side elevation showing use of an installed clamp, for wheelchair towing;

FIG. 8 is a perspective view showing a further modified clamp; and

Figure 9:
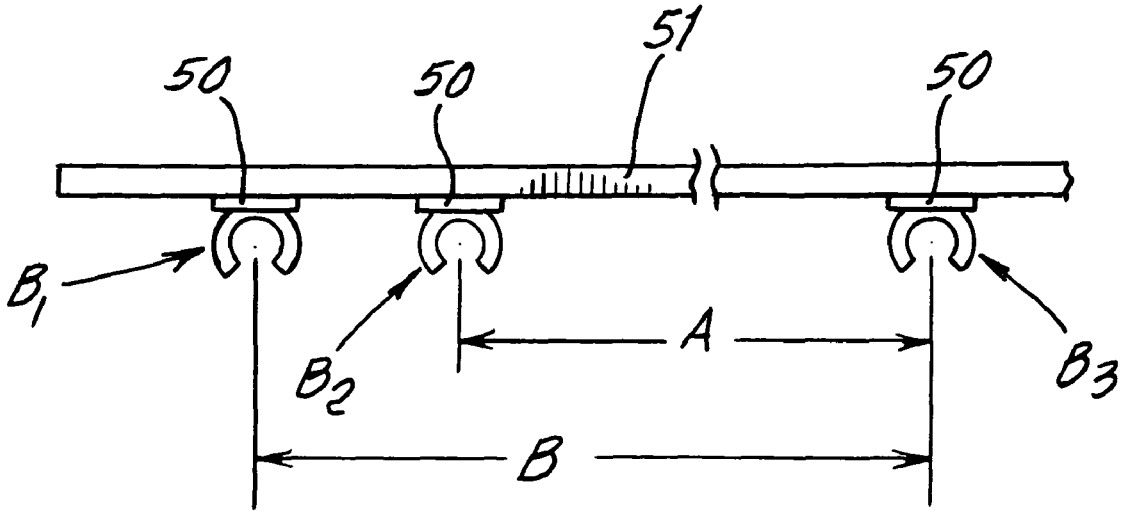

FIG. 9 is a view like FIG. 6*a* showing a clamp strut having three clamp brackets thereon for selective installation of either of two pairs of brackets to hold the wheelchair in selectively collapsed position.

DETAILED DESCRIPTION

Figure 1:
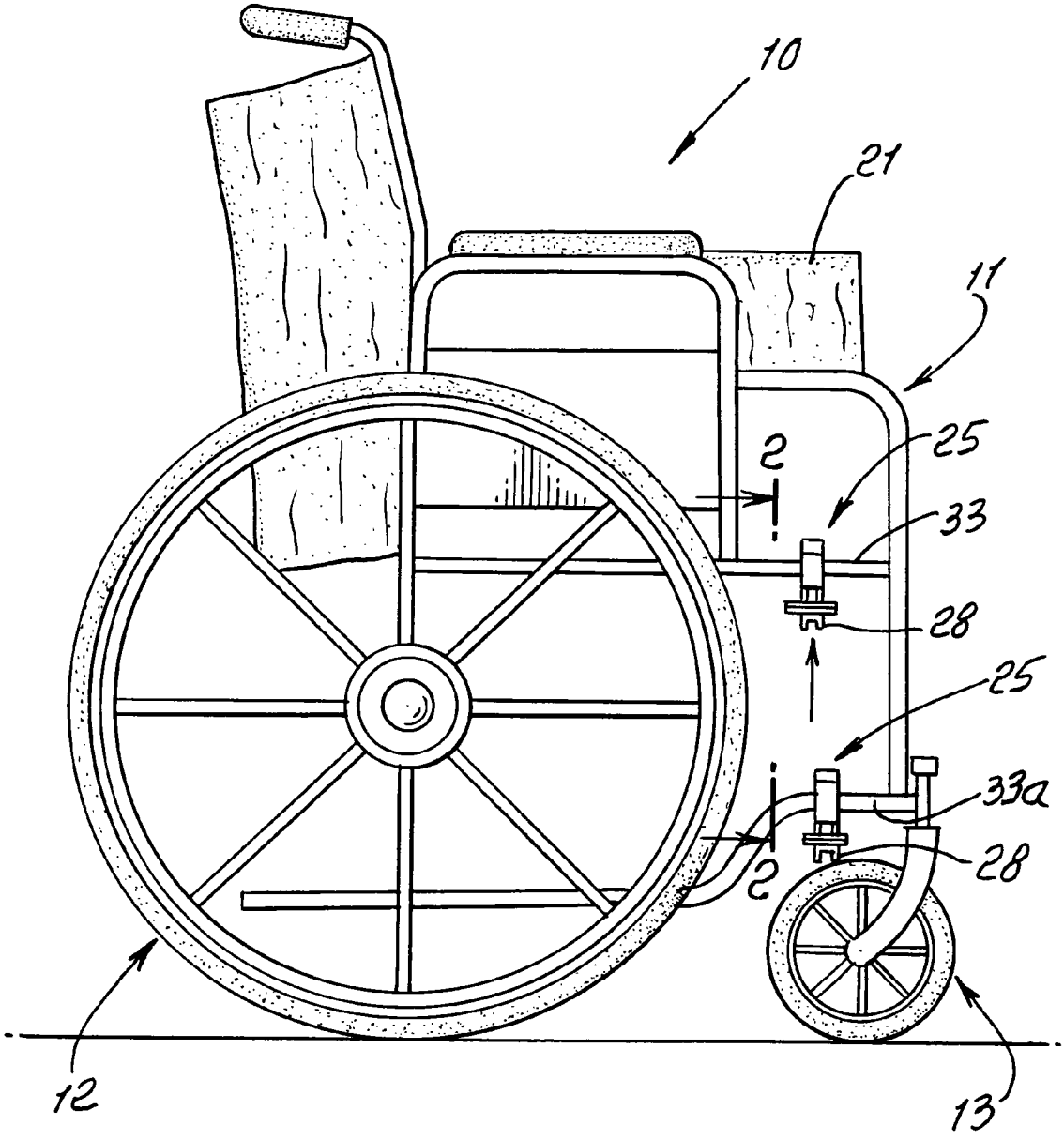
FIG. 1 is a side elevation of a wheelchair in collapsed position, with frame elements clamped in laterally spaced apart relation.

In FIGS. 1-3, a wheelchair 10 has a frame 11, main wheels 12, and smaller front wheels 13 and 14, pivotably connected to the frame upright members 15 and 16. Vertical bearings 17 and 18 support the upper ends of arms 17*a* and 18*a* to pivot about vertical axes 19 and 20. FIG. 2 shows the upright members 15 and 16 collapsed laterally and relatively toward one another to facilitate ease of wheelchair push-transport when the chair is not in use. In that configuration, the flexible seat 21 is bowed upwardly, seen in FIG. 1.

In accordance with the invention, positioner means is provided to be co-operable with the collapsed frame, and is configured for selectively retaining the wheelchair, in one position of said positioner means, and for allowing expansion of the wheelchair in another position of the positioner means relative to the frame, and for positioning the frame to space the wheelchair front wheels to allow free swiveling thereof.

The positioner means includes a clamp 25 attached to the frame tubes 32*a* and 33*a* at two laterally spaced apart, relatively collapsed positions 27 and 28 associated with the positions of the two front wheels 13 and 14, thereby to hold the chair in collapsed position as shown, in which the front wheels are effectively locked in position, with predetermined lateral spacing, for swiveling as during chair push-transport.

The clamp includes a laterally extending strut 28, and two brackets 29 and 30 carried by the strut and push assembled to the frame members 32 and 33 in directions normal to their axes, as for example vertically. FIG. 2 shows two such clamps 25 spaced apart vertically and assembled to generally horizontally forwardly directed frame members 32 and 33 at an upper elevation, and to frame members 32*a* and 33*a* at a lower elevation. Only one of such clamps is needed, although two may be used, as shown, for enhanced stability.

As stated, the lateral spacing of the brackets 29 and 30 is such as to allow pivoting of the front wheels 13 and 14. FIG. 2*a* shows lateral spacing of brackets 29 and 30 to hold collapsed frame members 32 and 33 sufficiently apart as to enable pivoting of the wheels about parallel axes 19 and 20, to avoid wheel clashing. Note clearance space 40 between the two wheels, one swung to the right, and the other swung to the left, their closest possible positions as during wheelchair travel, as can occur due to ground engagement of the wheelchair wheels during bodily turning.

In this regard, FIG. 9 shows an alternate clamp, having three brackets $B_1$, $B_2$, and $B_3$ attached to it as at 50 and spaced apart along the length of strut 51. This enables connection of brackets $B_1$ and $B_3$ to the frame, and alternative connection of brackets $B_2$ and $B_3$ to the frame, thereby enabling retention of the wheelchair in either of two selected collapsed positions, for best maneuvering of the wheelchair.

FIGS. 3, 4 and 4*a* show the bracket 29 and/or 30 to includes fixed and movable jaw parts 60 and 61. Part 60 is attached to a base 62 that can be attached as by fasten 63 to the strut 28. Jaw part 61 is pivotally attached at 64 to part 60 and a coil spring 65 urges curved grippers 60*a* and 61*a* relatively toward one another.

The grippers have cam walls 60*b* and 61*b* that diverge as shown. This enables forcible pushing of the walls 60*a* and 61*a* of the two brackets against and onto the tubular frame members 32 and 33, to capture the members between the grippers of the brackets. See push direction indicated by arrows 66 and 67. This is readily accomplished by manual push exertion on the strut 28 in arrow direction 68 in FIGS. 2 and 4. That may be a push up direction as in FIG. 4, or a push down direction 69 seen in FIG. 4*a*, enabling clamp assembly upwardly or downwardly, to the chair frame, as best suited to the user.

FIGS. 6 and 6*a* correspond to FIGS. 4 and 4*a*, but show a modified metallic bracket 79 in bow shape. It has resiliably yieldable walls 80 and 81 to embrace a frame tubular member 82, and diverging cam surfaces 83 and 84 relatively movable against, over and onto the member 82, during push on assembly. See struts push direction 85. FIG. 6 shows upward push assembly, and FIG. 6*a* shows downward push assembly in strut push direction 85*a*. Bracket walls 79*a* is shown as fastener connected at 88 to the strut.

FIG. 2 also shows that the clamp may have an alternate position at 25' in which the strut has been released from connection to one frame member, to hang downwardly for storage as during non-use. In that position, the strut hangs from single bracket connection at 30' to a frame member.

FIG. 7 shows use of the clamp, in assembled, position, for towing of the wheelchair. See line 70 connected at 71 to the strut 28.

FIG. 8 shows an alternate clamp having U-shape including a laterally elongated flat metallic base 90, and two integral bracket arms 91 and 92 projecting from the base. The base acts as a strut. The clamp also includes a second elongated base 94 attached to base 90, and two integral bracket arms 95 and 96 projecting from base. The spaces 97 and 98 between bracket arms 91 and 95, and between bracket arms 92 and 96, receive the wheelchair relatively collapsible frame members 98 and 99 as shown, and they are captivated as by an elongated retainer pin 100 projecting through openings 91*a*, 95*a*, 92*a* and 96*a*, in the arms, and suitably retained in the pin position.

I claim:

1. A positioner means co-operable with a collapsed wheelchair frame, including a front frame, and configured, for a) selectively retaining the wheelchair in collapsed position, in one position of said positioner means, and for allowing expansion of the wheelchair in another position of the positioner means relative to the frame, b) and for positioning said frame to space the wheelchair front wheels to allow free swiveling thereof, and comprising, in combination, c) a clamp attached to said frame at two spaced apart locations associated with the two front wheels, to lock the wheels at predetermined spacing, for swiveling, d) the clamp including brackets sized to releasably push-connect to the front frame at said two locations, e) each bracket having U-shape, with spaced walls projecting from a base, and a single elongated retainer projecting through aligned openings in all said walls, beneath wheelchair front frame structure, f) one bracket smaller than the other bracket and fitting in space defined between walls of the other bracket, whereby the bases of the two brackets extend in parallel adjacent relation, and said retainer extends parallel to the two bases.

2. The combination of claim 1 wherein the clamp includes a strut to which the brackets are connected, and including wheelchair frame members releasably embraced by the brackets.

3. The combination of claim 1 including a tow line connected to the strut for towing the wheelchair.

4. The combination of claim 1 wherein the clamp means includes a strut to which the brackets are connected and relative to which the brackets have fixed positions.

5. The combination of claim 1 wherein the two brackets are each defined by two U-shaped members each of which has a base and two walls projecting therefrom, the walls defining two spaces into which the frame members are received.

* * * * *